US011168710B2

(12) United States Patent
Huth et al.

(10) Patent No.: US 11,168,710 B2
(45) Date of Patent: Nov. 9, 2021

(54) CONTROL APPARATUS FOR SUPPLYING AT LEAST ONE HYDRAULIC CONSUMER WITH FLUID

(71) Applicant: HYDAC SYSTEMS & SERVICES GMBH, Sulzbach/ Saar (DE)

(72) Inventors: Heinz-Peter Huth, Ueberherrn (DE); Marc Anton, Voelklingen (DE)

(73) Assignee: HYDAC SYSTEMS & SERVICES GMBH, Sulzbach/Saar (DE)

( * ) Notice: Subject to any disclaimer, the term of this patent is extended or adjusted under 35 U.S.C. 154(b) by 0 days.

(21) Appl. No.: 16/497,013

(22) PCT Filed: Apr. 27, 2018

(86) PCT No.: PCT/EP2018/060866

§ 371 (c)(1),
(2) Date: Sep. 24, 2019

(87) PCT Pub. No.: WO2018/210550

PCT Pub. Date: Nov. 22, 2018

(65) Prior Publication Data

US 2020/0095987 A1 Mar. 26, 2020

(30) Foreign Application Priority Data

May 15, 2017 (DE) ..... 10 2017 004 634.4

(51) Int. Cl.
*F15B 11/16* (2006.01)

(52) U.S. Cl.
CPC ..... *F15B 11/165* (2013.01); *F15B 2211/2654* (2013.01)

(58) Field of Classification Search
CPC ..... F15B 11/17; F15B 2211/265; F15B 2211/2652; F15B 2211/2654; F15B 11/165
See application file for complete search history.

(56) References Cited

U.S. PATENT DOCUMENTS 5,261,232 A 11/1993 Maffini et al.
6,176,083 B1 * 1/2001 Ikari ..... E02F 9/2235 60/327

(Continued)

FOREIGN PATENT DOCUMENTS

DE 41 29 508 3/1993
DE 199 06 689 8/2000

(Continued)

OTHER PUBLICATIONS

International Search Report dated Jul. 19, 2018 in International (PCT) Application No. PCT/EP2018/060866.

*Primary Examiner* — F Daniel Lopez
(74) *Attorney, Agent, or Firm* — Wenderoth, Lind & Ponack, L.L.P.

(57) ABSTRACT

A control apparatus for supplying at least one hydraulic consumer with fluid has a variable displacement pump (10) controlled by a load-sensing pressure (LS). For a case-by-case increase in the volume flow in the supply of fluid (22) to the hydraulic consumer, the load-sensing pressure (LS) is passed via a control line (28) to a control circuit (2) that ensures the increase in the supply (22) by connecting in a constant-displacement pump (16) as soon as an operator calls for the relevant function by operating the control circuit (2).

19 Claims, 2 Drawing Sheets

(56) References Cited

U.S. PATENT DOCUMENTS

| | | | | |
|---|---|---|---|---|
| 6,901,754 | B2 * | 6/2005 | Jervis | E02F 9/2239 60/430 |
| 2013/0312401 | A1 * | 11/2013 | Frommelt | B62D 5/30 60/459 |
| 2015/0096290 | A1 | 4/2015 | Veit et al. | |

FOREIGN PATENT DOCUMENTS

| | | |
|---|---|---|
| DE | 10 2012 209 142 | 12/2013 |
| DE | 10 2014 004 932 | 5/2015 |
| EP | 2 672 125 | 12/2013 |

* cited by examiner

CONTROL APPARATUS FOR SUPPLYING AT LEAST ONE HYDRAULIC CONSUMER WITH FLUID

FIELD OF THE INVENTION

The invention relates to a control device for supplying at least one hydraulic consumer with fluid, having a variable displacement pump controllable by a load-sensing pressure.

BACKGROUND OF THE INVENTION

Load-sensing (LS) systems that make it possible to adapt the pressure and/or flow rate of a hydraulic pump to the conditions demanded by the consumer, are state of the art, cf. "Wikipedia, The Free Encyclopedia", chapter Load-Sensing. As is known, LS systems can be designed as open-center systems having fixed displacement pumps or as closed-center systems having variable displacement pumps, as is the case with the above-mentioned control device forming the subject of the application. Because of their energy-saving operation, LS systems are advantageously used to control components of the power hydraulics of mobile work equipment. Such equipment, such as agricultural tractors or equipment for soil cultivation, usually have several hydraulic consumers, such as a traction drive, power steering, lifting drives and the like. During operation of such equipment, not all of the consumers present have to be supplied with the full volume flow during typical phases of operation at the same time. Among other things, for reasons of cost, the variable displacement pump, conventionally designed as a swing pump, does not have to be designed for the flow rate occurring in exceptional situations. In special or extreme work situations, for example when using a tractor for fieldwork, this design can result in an undersupply during maneuvers at the headland, where in addition to the traction drive, steering and machine devices, lifting drives may simultaneously request maximum flow.

SUMMARY OF THE INVENTION

Based on this problem, the invention addresses the problem of providing an improved control device of the type mentioned, which ensures a particularly reliable supply of hydraulic consumers.

According to the invention, this object is basically achieved by a control device having, as a significant feature of the invention, for a case-by-case increase of the volume flow in the inlet of the hydraulic consumer, the load sensing pressure is transmitted to a control circuit. The control circuit increases the inlet volume flow by connecting a fixed displacement pump as soon as an operator initiates the pertinent function by operating the control circuit. Thus, the invention not only provides a kind of boost function for extreme work situations, but simultaneously provides a safeguard against a possible risk to occupational safety, which can be caused by an abrupt change in in-service behavior when the fixed displacement pump is turned on. Because the increase in the incoming volume flow depends on the actuation of the control circuit to be performed by the operator, the risk that changes in performance will occur that have not been anticipated by the operator, such as changed steering angles, accelerated driving or lifting movements, is avoided because the operator has to activate the boost function.

The control circuit can advantageously have first and second control valves. The first control valve of the load sensing pressure in the control line. The second control valve can be controlled by the operator.

In preferred exemplary embodiments, the first control valve is a proportional valve, in particular a 2/2-way proportional valve. One control side of the first control valve is pressurized with, besides a spring pre-load, the load sensing pressure. The other control side of the first control valve is pressurized with the inlet pressure in the inlet of the individual hydraulic consumer.

Advantageously, an electromagnetically actuated switching valve, in particular a 2/2-way switching valve, is provided as a second control valve to be actuated by the operator. The second control valve opens a fluid path from the fixed displacement pump to a storage tank in its unactuated position. In its operator-actuated position, the relevant fluid path to the storage tank is blocked, such that in this actuated state, the volume flow of the fixed displacement pump is available to increase the inlet volume flow.

In this case, the second control valve can form a bypass of the first control valve by connecting the input and the output of the first control valve in a fluid-conveying manner to the input and the output of the second control valve, respectively.

The output of the fixed displacement pump can be connected to the inputs of the first and second valves via a branch-off point.

To supply the volume flow of the fixed displacement pump to the inlet, the inlet of the fixed displacement pump can be connected to the output of the variable displacement pump via a connecting line, in which a check valve is installed. In particular, the check valve is in the form of a spring-loaded check valve, which opens in the direction of the variable displacement pump and closes in the direction of the fixed displacement pump.

In the connection between the variable displacement pump and the relevant hydraulic consumer, the connecting line including the check valve can be connected first, and subsequently a control line, which pressurizes the first valve with the inlet pressure.

To protect the fixed displacement pump, a pressure limiting valve is installed in a bypass line in parallel to the second control valve. When triggered, the volume flow of the fixed displacement pump is transmitted to the storage tank, bypassing the first and second control valves.

With particular advantage, the control circuit may be formed as a control block, which includes the first and the second control valves, the check valve and the pressure relief valve and which has ports for the fluid-conveying connection of the variable displacement pump acting as a swing angle pump, the fixed displacement pump, the relevant consumer, the storage tank and the load sensing control line.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
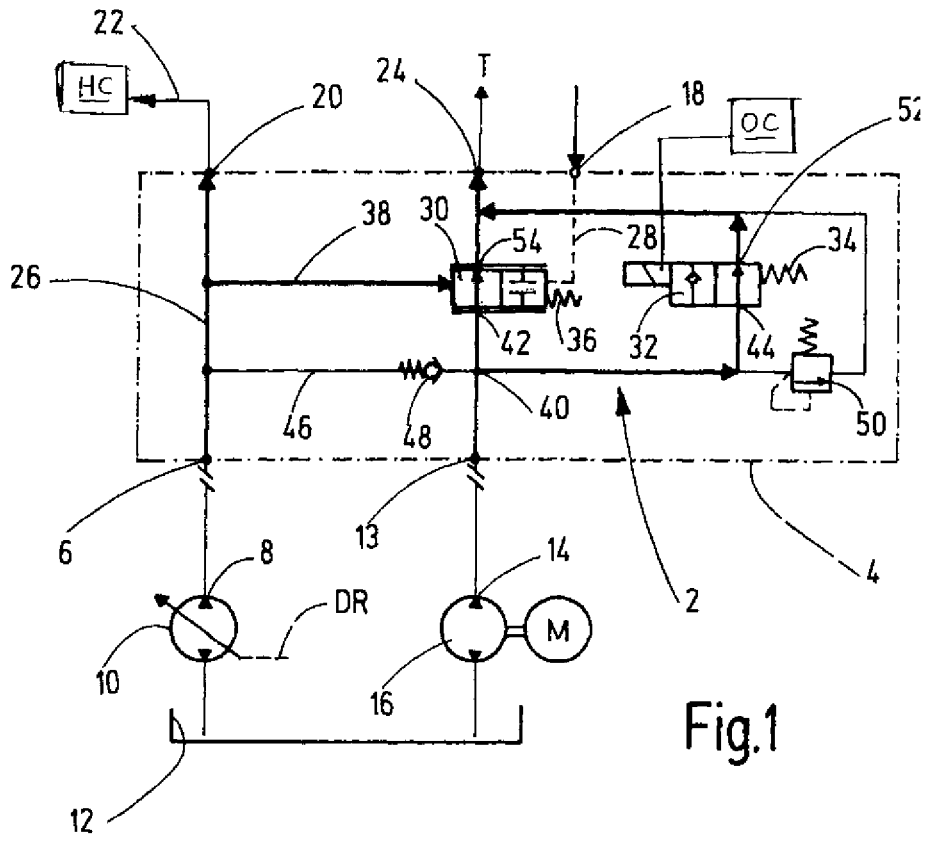
FIG. 1 is a schematic circuit diagram of a control device according to an exemplary embodiment of the invention, wherein the operating state is shown for an LS signal not signaling demand and for a non-actuated control device.

The control device according to the invention has a control unit or circuit 2, the components of which have been combined to form a control block 4. The control block 4 has a first input port 6, which is connected to the output 8 of a variable displacement pump in the form of a swing pump 10, which is connected to a storage tank 12 on the input side. A second input port 13 of the control block 4 is connected to the output 14 of a fixed displacement pump 16, which, like the swing pump 10, can be motor-driven and is connected to the storage tank 12 on the input side. In the present example, the fixed displacement pump 16 is formed by a gear pump. A demand signal LS signal can be transmitted to a third input terminal or demand LS signal input port 18 of the control block 4. More precisely, in the case of several consumers to be supplied, the highest occurring LS signal is supplied via shuttle valves. A first output port 20 on the control block 4 is routed to the consumer inlet 22 of a hydraulic consumer HC. A second outlet port 24 is routed to the storage tank 12.

The swing pump 10 is part of a closed-center system, otherwise not shown, i.e., the swing angle is adjusted via a pressure regulator DR according to the LS signal. To illustrate the course of the oil flows, resulting in the different operating conditions illustrated in FIGS. 1 to 4, the lines routed to the oil flow lines have been drawn using thicker line thickness. In the control block 4, a supply line 26 is routed from the first input terminal 6 to the first output terminal 20, and thus, to the inlet 22. A control line 28 supplies the LS pressure from the third input port 18 to the control circuit 2. As further components, the control block 4 includes a first or main control valve 30 and a second or operator control valve 32. The first control valve 30 is a 2/2-way proportional valve. The second control valve 32 is a 2/2-way switching valve. The second control valve 32 can be activated by an operator, can be actuated electromagnetically via an operator control OC, and can be brought from an unactuated switching position corresponding to the flow position to an actuated switching position, in which the second control valve 32 is locked against the force of a return spring 34. The first control valve 30 is pressurized on the one hand or control end by a compression spring 36 and by the individual LS-pressure, supplied via the control line 28, and on the other hand or control end is pressurized by the inlet pressure present in the supply line 26 via a further control line 38. The output 14 of the fixed displacement pump 16 is connected to the input 42 of the first control valve 30 and to the input 44 of the second control valve 32 via the second input connection 13 and via a branching point 40. As a result, a fluid path to the second output port 24 of the control block 4 and thus to the storage tank 12 is open from the outlet 14 of the fixed displacement pump 16 if the second control valve 32 is in the unactuated switching position. When the second control valve 32 is in non-actuated switching position, the volume flow of the fixed displacement pump 16 is discharged to the tank without restriction.

The output 14 of the fixed displacement pump 16 is also connected to the supply line 26, routed from the swing pump 10 to the inlet 22 via a connecting line 46. A check valve 48 is installed in the connecting line 46, which check valve opens in the direction of the supply line 26. This connecting line 46 is connected to the supply line 26, viewed in the flow direction, upstream of the control line 38. The first control valve 30 and the second control valve 32 are connected to the second output port 24 of the control block 4, and thus, to the storage tank 12 on the output side. The control block 4 is completed by a pressure limiting valve 50, which secures the fixed displacement pump 16 to the storage tank 12 and is inserted as a bypass to the second valve 32 between its input 44 and its outlet 52 connected to the tank.

FIG. 1 shows an operating state in which the second valve 32 is in the unactuated switching position, that is to say the open position. Thus, regardless of the valve position of the first control valve 30, as mentioned, the volume flow of the fixed displacement pump 16 is routed from the branch point 40 to the tank. In the state of FIG. 1, the first control valve 30 is also not pressurized by an LS pressure signaling demand via the line 38. The first control valve 30, which forms the pressure compensator of an open-center system in conjunction with the fixed displacement pump 16, is then controlled by the supply pressure of the swing pump 10 present in the control line 38 against the action of the compression spring 36 from the blocked position. In this state, a fluid path is then formed to the tank, also via the output 54 of the first control valve 30. In FIG. 1, this oil flow is illustrated using thicker lines.

Figure 2:
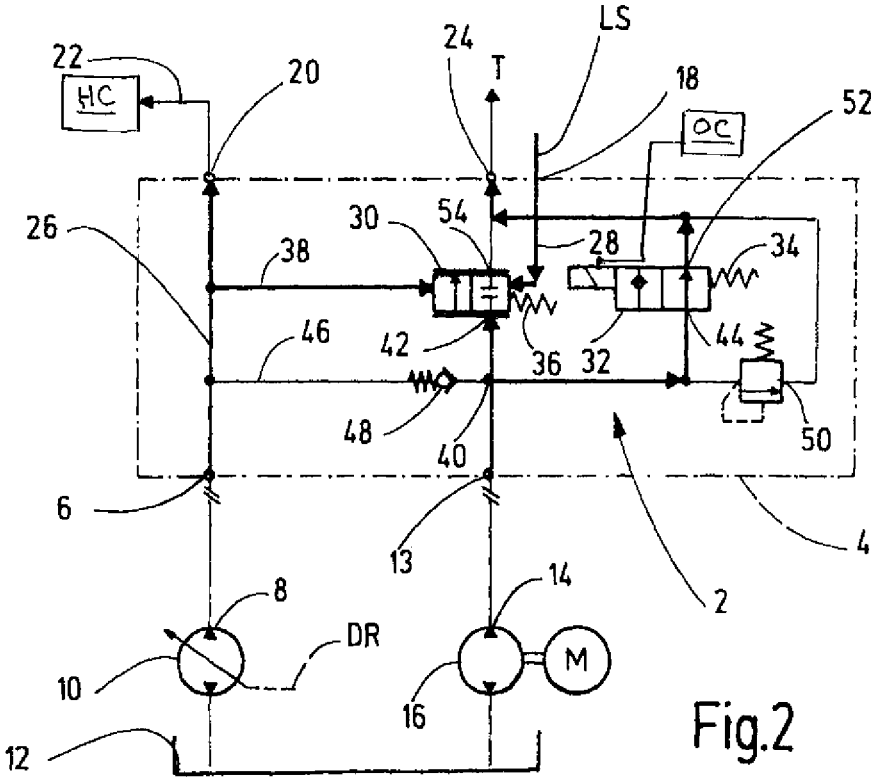
FIG. 2 is a schematic circuit diagram of the control device of FIG. 1, wherein the operating state is shown for an LS signal signaling demand and for a non-actuated control device.

FIG. 2 shows an operating state, in which the fixed displacement pump 16 likewise does not contribute to increasing the inlet volume, because the second control valve 32 is again not actuated, i.e., the volume flow of the fixed displacement pump 16 is diverted to the tank. In contrast to FIG. 1. However, an LS pressure is effective at the first control valve 30, which signals the need for an additional supply of the inlet 22. In conjunction with the action of the compression spring 36, the first control valve 30 is then actuated into the locked state. Although no volume of the swing pump 16 flows through the first control valve 30, but as the second control valve 32 is not actuated, this valve is used for discharging purposes, such that the fixed displacement pump 16 again does not contribute to the supply.

Figure 3:
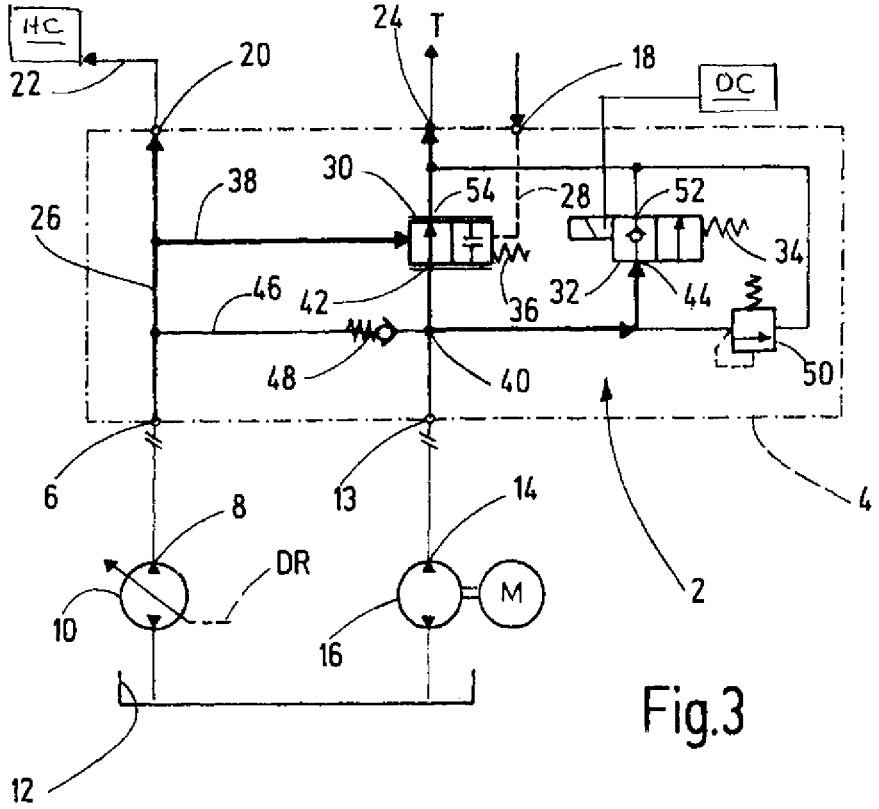
FIG. 3 is a schematic circuit diagram of the control device of FIGS. 1 and 2, wherein the operating state is shown for an LS signal not signaling demand and for an actuated control device.

In the operating state of FIG. 3, the operator switches the second control valve 32 into the blocking state, i.e., 32 no volume flows out of the fixed displacement pump 16 via this valve. At the same time, however, no LS pressure acts on the first control valve 30 via the control line 28, which would be sufficient to actuate the first control valve 30 against the supply pressure acting on the control line 38 into the blocking position, such that the first control valve 30 permits a flow to the tank. Despite the actuated second control valve 32, therefore, no boost function is activated.

Figure 4:
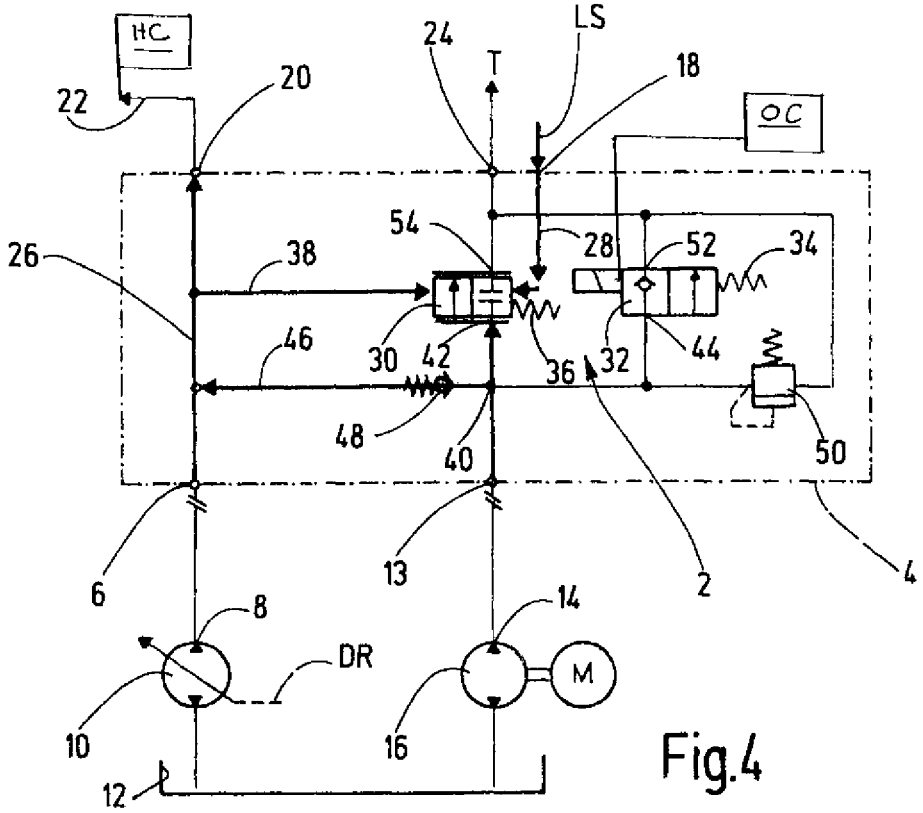
FIG. 4 is a schematic circuit diagram of the control device of FIGS. 1 to 3, wherein the operating state is shown for an LS signal signaling demand and for an actuated control device.

In the state shown in FIG. 4, an LS-pressure is effective on the first control valve 30 via the control line 28, which signals an additional supply, such that the first control valve 30 is actuated into the blocking position. At the same time, the operator activates the boost function by actuating the second control valve 32 into the blocking position. In these valve positions, the entire volume flow of the fixed displacement pump 16 is fed into the supply line 26 via the branch point 40, the first check valve 48 and the connecting line 46 and increases the volume flow in the inlet 22.

Because the boost function can only be activated, even if the LS pressure requests an additional supply, and thus, the first control valve 30 is blocked, as shown in FIG. 2, if the operator, as shown in FIG. 4, actuates the second control valve 32, the invention provides a safety-enhancing hydraulic lock of the boost function.

While one embodiment has been chosen to illustrate the invention, it will be understood by those skilled in the art that various changes and modifications can be made therein without departing from the scope of the invention as defined in the claims.

The invention claimed is:

1. A control device supplying a hydraulic consumer, the control device comprising:

a variable displacement pump controllable by a load-sensing pressure;

a fixed displacement pump; and a control circuit with an operator control valve, with a first input port connected in fluid communication with the variable displacement pump, with a second input port connected in fluid communication with the fixed displacement pump, with a load-sensing pressure inlet port connected in fluid communication to a control line and with a first outlet port connectable in fluid communication with the hydraulic consumer, the control circuit being capable of providing a fluid volume flow supplied by the variable displacement pump via the first input port to the first outlet port and increasing the fluid volume flow supplied by the variable displacement pump to the first outlet port by the fixed displacement pump via the second input port upon an operator actuating the control circuit, the operator control valve being actuatable only by the operator via an operator control connected to the operator control valve independently of load sensing pressure, the control circuit comprises a main control valve, the main control valve having a first control end connected in fluid communication with the load-sensing pressure inlet port for actuation of the first control valve, the main and operator control valves being connected in fluid communication with the second input port.

2. A control device according to claim 1 wherein the main control valve is a proportional valve with the first control end of the main control valve pressurized with a preloaded spring in addition to the pressure from the load-sensing pressure inlet port and with a second control end of the main control valve being connected in fluid communication with the first outlet port to be capable being pressurized by pressure from the first outlet port.

3. A control device according to claim 2 wherein the proportional valve is a 2/2-way proportional valve.

4. A control device according to claim 2 wherein the operator control valve is an electrically operable switching valve having an unactuated position opening a tank fluid path from the second input port to a tank port connectable in fluid communication to a storage tank and having an operator-actuated activating position blocking the tank fluid path.

5. A control device according to claim 4 wherein the operator control valve is arranged in a bypass line of the main control valve, the main control valve having an input and an output connected in fluid communication with an input and an output of the operator control valve, respectively.

6. A control device according to claim 1 wherein the operator control valve is an electrically operable switching valve having an unactuated position opening a tank fluid path from the second inlet port to a tank port connectable in fluid communication to a storage tank and having an operator-actuated activating position blocking the tank fluid path.

7. A control device according to claim 6 wherein the electrically operable switching valve is a 2/2-way switching valve.

8. A control device according to claim 1 wherein the operator control valve is arranged in a bypass line of the main control valve, the main control valve having an input and an output connected in fluid communication with an input and an output of the operator control valve, respectively.

9. A control device according to claim 8 wherein an output of the fixed displacement pump is connected in fluid communication to the input of the main control valve via the second input port and the input of the operator control valve via a branching point connected in fluid communication with the second input port.

10. A control device according to claim 9 wherein the first input port is connected in fluid communication with the second input port via a connecting line with a check valve in the connecting line, the check valve opening in a direction of the first input port and closing in a direction of the second input port.

11. A control device according to claim 10 wherein the check valve is a spring-loaded check valve biased to a closed position.

12. A control device according to claim 10 wherein a control line downstream of the connecting line with the check valve provides a fluid communication connection between the first input port and a control end of the main control valve.

13. A control device according to claim 10 wherein the control circuit comprises a control block with the main and operator control valves, the check valve and a pressure relief valve in the control block, the control block having the first and second input ports, the load-sensing pressure inlet port, the first outlet port and a tank port.

14. A control device according to claim 1 wherein a pressure limiting valve is in a bypass line arranged in parallel to the main and operator control valves, the pressure limiting valve conveys volume flow of the fixed displacement pump to a tank port of the control circuit bypassing the main and operator control valves.

15. A control device according to claim 1 wherein an output of the fixed displacement pump being connected in fluid communication to an input of the operator control valve via a branching point connected in fluid communication with the second input port.

16. A control device according to claim 15 wherein the first input port is connected in fluid communication with the second input port via a connecting line with a check valve in the connecting line, the check valve opening in a direction of the first input port and closing in a direction of the second input port.

17. A control device according to claim 16 wherein the connecting line with the check valve and a control line downstream of the connecting line with the check valve provides a fluid communication connection between the first input port and the first outlet port, with the control line being capable at applying fluid pressure at the first outlet port to the first control valve.

18. A control device according to claim 17 wherein a pressure limiting valve is in a bypass line arranged in parallel to the main and operator control valves, the pressure limiting vale conveys volume flow of the fixed displacement pump to a tank port of the control circuit via the second input port bypassing the main and operator control valves.

19. A control device according to claim 1 wherein the main control valve has a second control end in fluid communication in fluid communication with the first outlet port, an inlet port connected in fluid communication with the second input port and an outlet port connected in fluid communication with a tank port connectable in fluid communication to a storage tank;

the operator control valve has an inlet port in fluid communication with the second input port and an outlet port in fluid communication with the tank port;

the second input port is connected in fluid communication the first input port via a connecting line with a check valve in the connecting line, the check valve opening in a direction of the first input port and closing in a direction of the second input port, the second control end of the main control valve being in fluid communication of an outlet end of the check valve; and the first input port is in direct fluid communication with the first outlet port without flow through the check valve.

* * * * *